US005315124A

United States Patent [19]

Goss et al.

[11] Patent Number: 5,315,124

[45] Date of Patent: May 24, 1994

[54] NUCLEAR GAUGE

[75] Inventors: John D. Goss, San Jose; Steve Axelrod, Los Altos; Mathew Boissevain, Los Altos Hills; Philip M. Hegland, San Jose; Scott C. Wiley, Sunnyvale, all of Calif.

[73] Assignee: Measurex Corporation, Cupertino, Calif.

[21] Appl. No.: 856,382

[22] Filed: Mar. 20, 1992

[51] Int. Cl.[5] ..... G21F 5/02

[52] U.S. Cl. ..... 250/497.1; 250/496.1

[58] Field of Search ..... 250/496.1, 497.1

[56] References Cited

U.S. PATENT DOCUMENTS

| | | | |
|---|---|---|---|
| 2,477,648 | 8/1949 | Piggot et al. | 250/497.1 |
| 2,772,361 | 11/1956 | Hiestand | 250/497.1 |
| 2,889,464 | 6/1959 | Ruehle | 250/497.1 |
| 2,891,168 | 6/1959 | Goertz et al. | 250/497.1 |
| 2,984,748 | 5/1961 | Converse et al. | 250/497.1 |
| 3,085,157 | 4/1963 | Ginsburgh et al. | 250/497.1 |
| 4,284,887 | 8/1981 | Kusumoto et al. | 250/496.1 |
| 4,516,256 | 5/1985 | Wapperom | 250/497.1 |

*Primary Examiner*—Bruce C. Anderson

*Attorney, Agent, or Firm*—Burns, Doane, Swecker & Mathis

[57] ABSTRACT

A nuclear gauge for making measurements of traveling webs in continuous sheet-making processes includes an enclosure, an encapsulated nuclear source, and a wheel-like member mounted in the enclosure means for carrying the encapsulated nuclear source between two angularly-displaced positions. The first of the angularly-displaced positions is the position where the encapsulated nuclear source makes measurements of a web that travels past the gauge and the second position is the location where the encapsulated nuclear source faces a sidewall of the enclosure means at a location remote from the first position. The nuclear gauge also has an aperture which is formed through the enclosure for providing a window through which the encapsuled nuclear source, when located in the first position, can emit radiation onto a web that travels past the window.

16 Claims, 8 Drawing Sheets

FIG._7
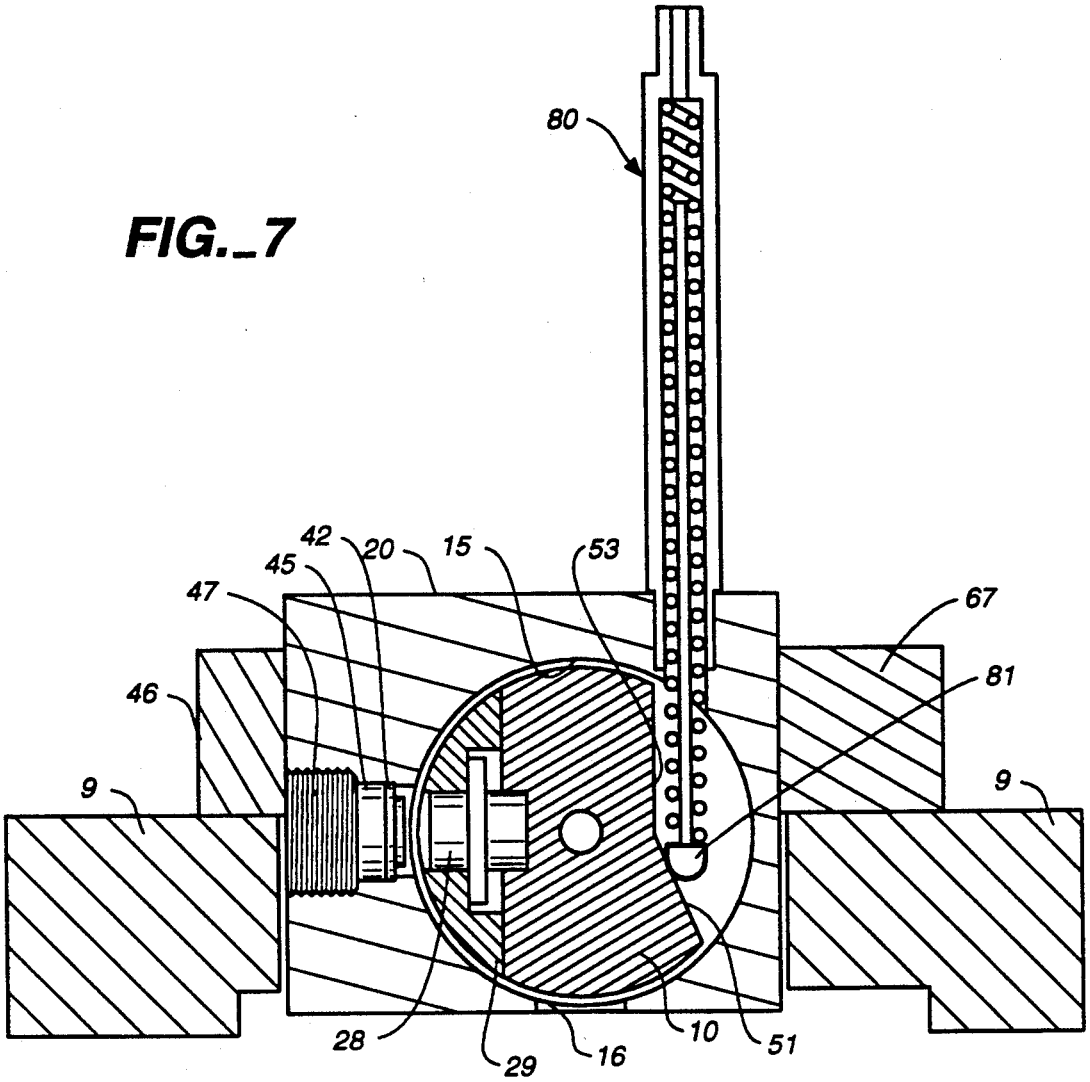
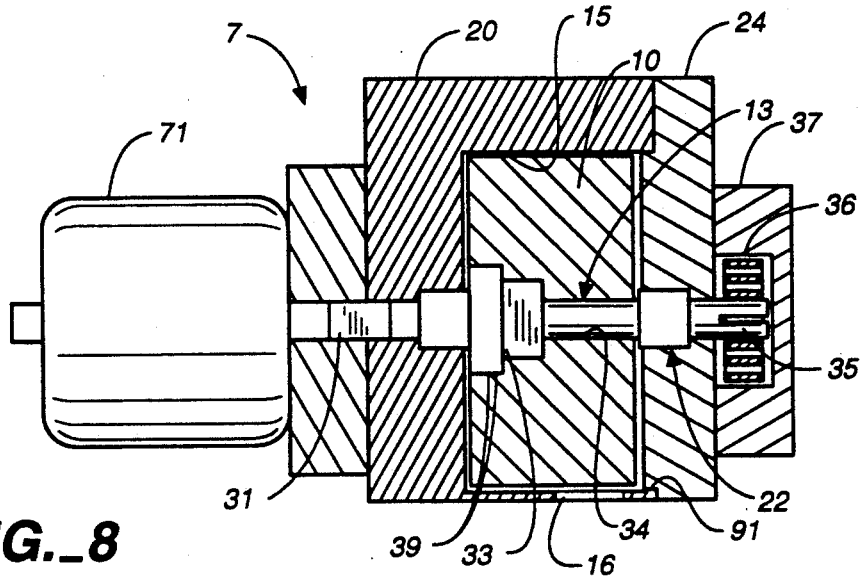
FIG._8

NUCLEAR GAUGE

BACKGROUND OF THE INVENTION

1. Field of the Invention

The present invention relates to nuclear gauges for making measurements of traveling webs in continuous sheet-making systems.

2. State of the art

In continuous sheet-making systems, on-line measurements are highly desirable. The on-line measurements can provide, for instance, early indications of upsets in process conditions, thus allowing process controls to be effected before substantial quantities of substandard material are produced. In practice, however, accurate on-line measurements are difficult to make. The measurement difficulties arise, in part, because modern sheet-making machines are large and operate at high speeds. Some paper-making machines, for example, produce paper webs that are 100 to 400 inches wide at rates of up to 100 feet per second.

For making on-line measurements of properties of traveling webs in continuous sheet-making systems, it is common to employ sensors that periodically traverse, or scan, the webs. One type of scanning sensor is the nuclear gauge. In operation, nuclear gauges direct nuclear radiation (beta rays) against a surface of a traveling web while detecting the absorbed (or transmitted) radiation. (The quantity of nuclear radiation absorbed over a given area is a measure of the basis weight of the absorbing material.) Nuclear scanning gauges typically use radioactive krypton gas as the beta-ray source.

When using nuclear gauges, safety is a major concern. For safety reasons, it is important that nuclear sources are appropriately shielded, especially when not in use, to prevent accidental exposure of personnel who might be working near the gauge. In conventional practice, shielding of a nuclear gauge is accomplished by mounting the nuclear source material to a protective housing that has a shuttered window. When the nuclear gauge is in use, the shuttered window is opened to allow radiation to be emitted onto a traveling web. When the gauge is not in use, the shuttered window is closed, thus blocking radiation and reducing the opportunities for accidental exposure.

Although shielding of nuclear gauges is necessary, the design of the shielding must not impair the accuracy of measurements that are made by the gauge.

SUMMARY OF THE INVENTION

The present invention, generally speaking, provides a nuclear gauge for making measurements of traveling webs in continuous sheet-making processes. In the preferred embodiment, the nuclear gauge comprises an enclosure means, an encapsulated nuclear source, and a rotatable means mounted in the enclosure means for carrying the encapsulated nuclear source between two angularly-displaced positions. In practice, the two angularly-displaced positions comprise a) a first position whereat the encapsulated nuclear source is positioned for making measurements of a web that travels past the gauge and b) a second position whereat the encapsulated nuclear source is positioned to face a sidewall of the enclosure means at a location remote from the first position. Also in practice, the nuclear gauge includes an aperture which is formed through the enclosure means to intersect the cylindrical cavity for providing a window through which the encapsuled nuclear source, when located in the first position, can emit radiation onto a web that travels past the window. Still further in practice, the outer diameter of the wheel-like member approximate the inside diameter of the cylindrical cavity so that, as the wheel-like member is rotated, the spacing between the periphery of the wheel-like member and the interior wall of the cylindrical cavity remains essentially constant.

In the preferred embodiment, the nuclear gauge further includes a plug of material having a low atomic number, which plug is mounted in the sidewall of the cavity at the second position for absorbing beta rays that are emitted from the encapsulated nuclear source. In practice, the low atomic number material is selected from the group consisting of aluminum, beryllium, carbon and Delrin.

Further in the preferred embodiment, the nuclear gauge includes a fire pin means for returning the wheel-like member to the second position in the event of a fire. In practice, the wheel-like member has a generally V-shaped slot formed in its periphery, the faces of which provide stop faces. Also in practice, the fire pin includes a spring-loaded member which is positioned such that, upon release, it applies pressure against one of the stop faces of wheel-like member to forces the wheel-like member to rotate to the second position, thereby reducing the chance that radiation will be emitted from the nuclear gauge.

BRIEF DESCRIPTION OF THE DRAWINGS

The present invention can be further understood with reference to the following description in conjunction with the appended drawings, wherein like elements are provided with the same reference numerals. In the drawings:

FIG. 7 is a cross-sectional view similar to FIG. 6 but showing the fire pin in a second position; and FIG. 8 is a cross-sectional view of the gauge taken along section line 8—8 in FIG. 1.

DETAILED DESCRIPTION OF THE PREFERRED EMBODIMENTS

Figure 1:
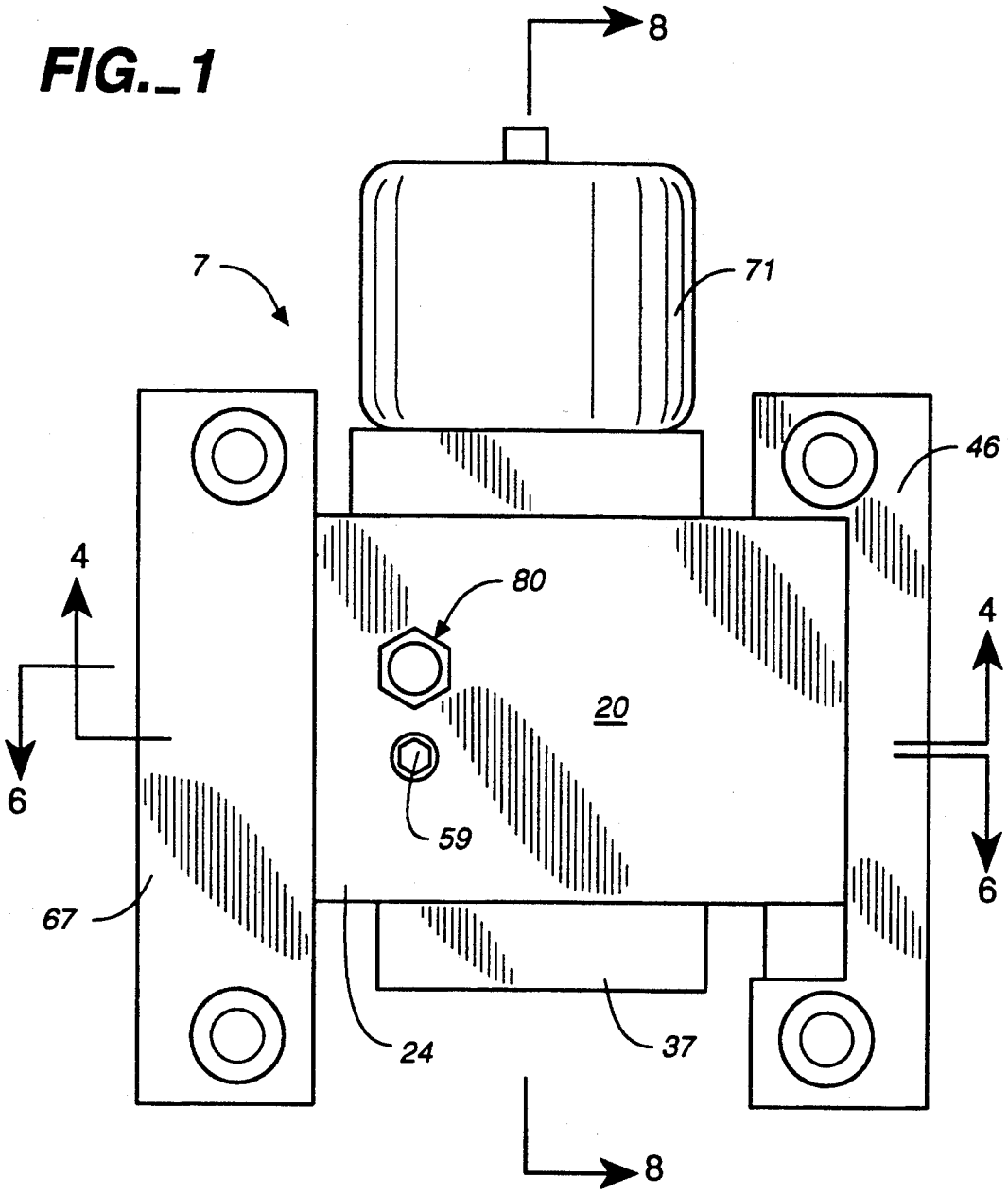
FIG. 1 is a plan view of the nuclear gauge of the present invention.
Figure 2:
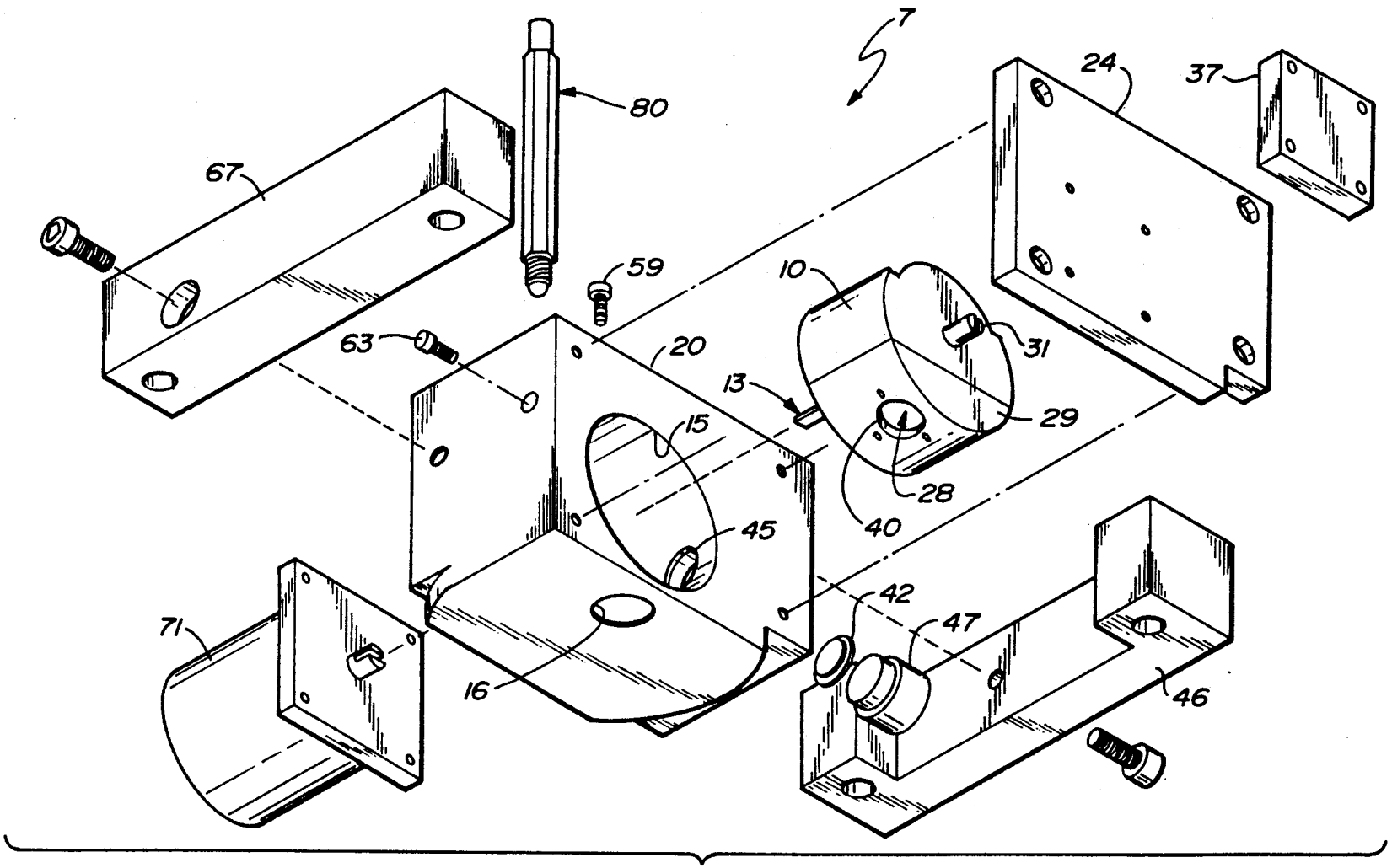
FIG. 2 is an exploded pictorial view of components of nuclear gauge of FIG. 2.

A nuclear gauge 7, as shown in FIG. 2, generally includes a housing enclosure 20 and a wheel-like member 10. The wheel-like member is mounted on a rotary shaft 13 for rotation within a cylindrical cavity 15 in the enclosure 20. Further, the nuclear gauge 7 includes a capsule 28 which is carried by the wheel-like member 10. Still further, the nuclear gauge includes an aperture 16 which is formed through the enclosure 20 to intersect the cylindrical cavity 15. The aperture 16, as will be explained further below, provides a window through which the capsule 28 can emit radiation onto a web that travels past the window.

In practice, the housing enclosure 20 is made from a material having a high atomic number, typically a tungsten alloy. Also in practice, the capsule 28 contains a nuclear source, such as radioactive krypton gas.

As further shown in FIG. 2, the rotary shaft 13 extends axially through the cylindrical cavity 15. One end of the rotary shaft 13 is shaped to be driven by a rotary actuator such as a pneumatic actuator 7. In use of such an actuator, the air release rate can be controlled by, for example, adjusting the size of the release vent. (This is important for driving the wheel-like member 10 smoothly between its terminal positions.) The other end 31 of the rotary shaft 13 is supported by bearings in a closure member 24. The closure member 24, as its name implies, serves as a closure across one end of the cylindrical cavity 15. The other end of the cylindrical cavity is closed by a rear wall of the enclosure 20.

Still further with regard to FIG. 2, it should be noted that the outer diameter of the wheel-like member 10 closely approximates the inside diameter of the cylindrical cavity 15. Accordingly, as the wheel-like member is rotated, the spacing between the periphery of the wheel-like member 10 and the interior wall of the cylindrical cavity 15 remains essentially constant (and small), thereby reducing the quantity of stray radiation which is emitted from the nuclear gauge 7.

As also shown in FIG. 2, the rotary shaft 13 has an end 31 for connecting to a coil spring member 36 whose other end is seated in a cover member 37. The cover, in turn, is fixed to the closure member 24. The function of the coil spring member 36 is to reduce backlash of the wheel-like member 10 at its terminal position. The reduction of backlash is important for assuring that the wheel-like member 10 is accurately positioned at its terminal position. The spring member 39 also acts as a fail-safe means for rotating the wheel-like member to the closed position in the event of power failure.

Figure 2A:
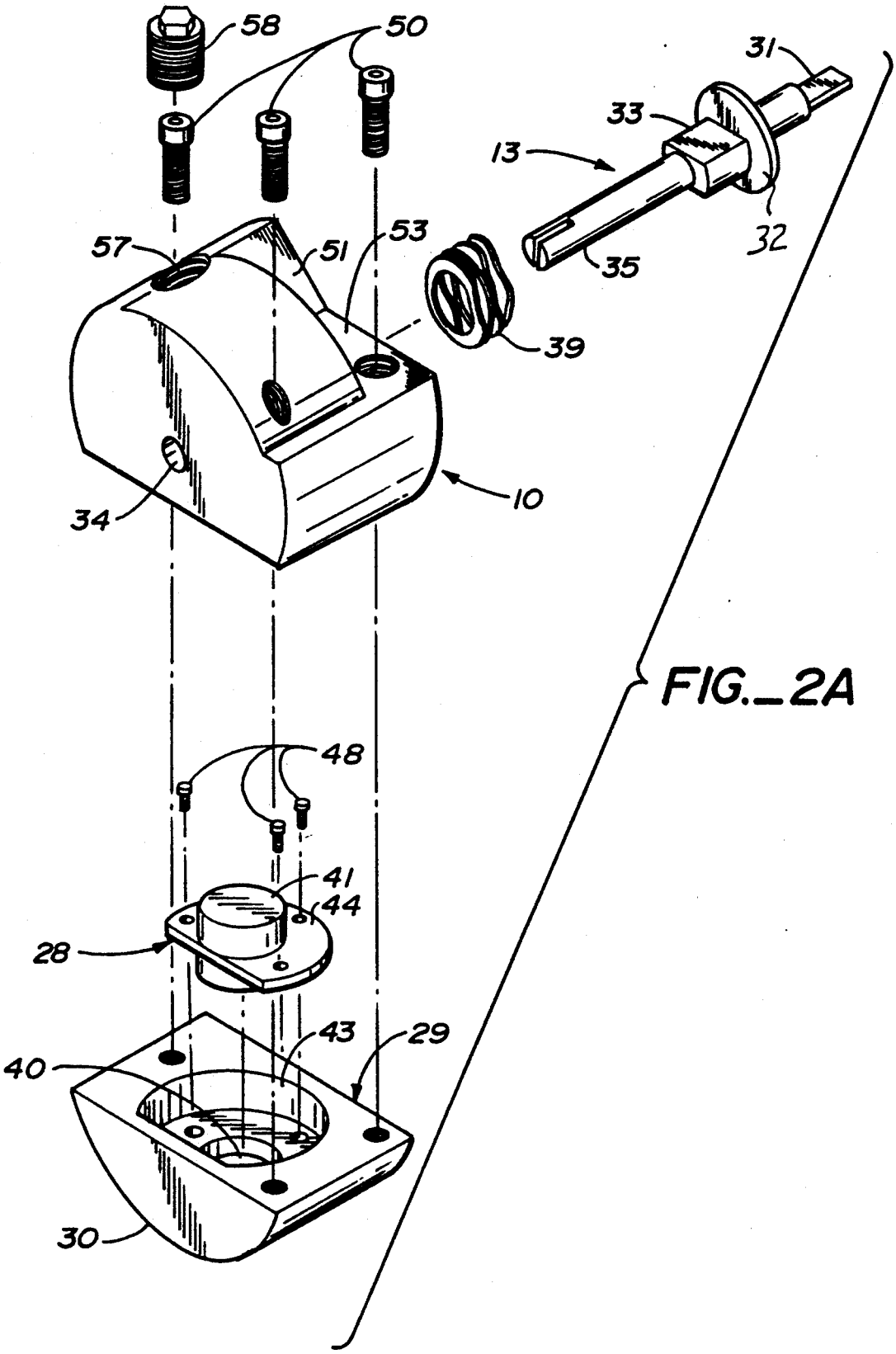
FIG. 2A is an exploded pictorial view, drawn to an enlarged scale, of several of the components shown in FIG. 2.

Referring now to FIG. 2A, it can be seen that the rotary shaft 13 also has a medial section 33. As shown, the medial section 33 has a shape that keys into an axial bore 34 which is formed through the wheel-like member 10; as a result, the wheel-like member 10 rotates with the rotary shaft. The medial section also has a radial flange 32 and a spring member 39 which seats against the flange. The function of the spring member 39 is to pre-load the bearings which journal the rotary shaft 13 and thereby to assist in preventing wobbling of the wheel-like member as the nuclear gauges is carried to scan across a web of sheet material.

The capsule 28, as also shown in FIG. 2A, is connected to the wheel-like member 10 by means of a cradle member 29. In the illustrated embodiment, the cradle member has an arcuate periphery 30 of generally the same radius as the wheel-like member 10. The cradle member is secured to the wheel-like member 10 as by threaded members 50. With the cradle member so secured, the overall cross-sectional profile of the wheel-like member is generally circular. This profile, as mentioned above, is important for maintaining constant spacing between the periphery of the wheel-like member 10 and the interior wall of the cylindrical cavity 15.

As still further shown in FIG. 2A, the capsule 28 has a generally cylindrical body 41 and a radially-extending flange 44. The body 41 is accepted within a circular recess 43 which is formed in the cradle member 29. A circular opening 40 is formed centrally of the recess 43. It may be noted that the centerline of the recess 43 and the centerline of the opening 40 are generally aligned with a radius of the wheel-like member 10. In the illustrated embodiment, the radially-extending flange 44 is secured to the cradle member 29 as by screw members 48.

Figure 3:
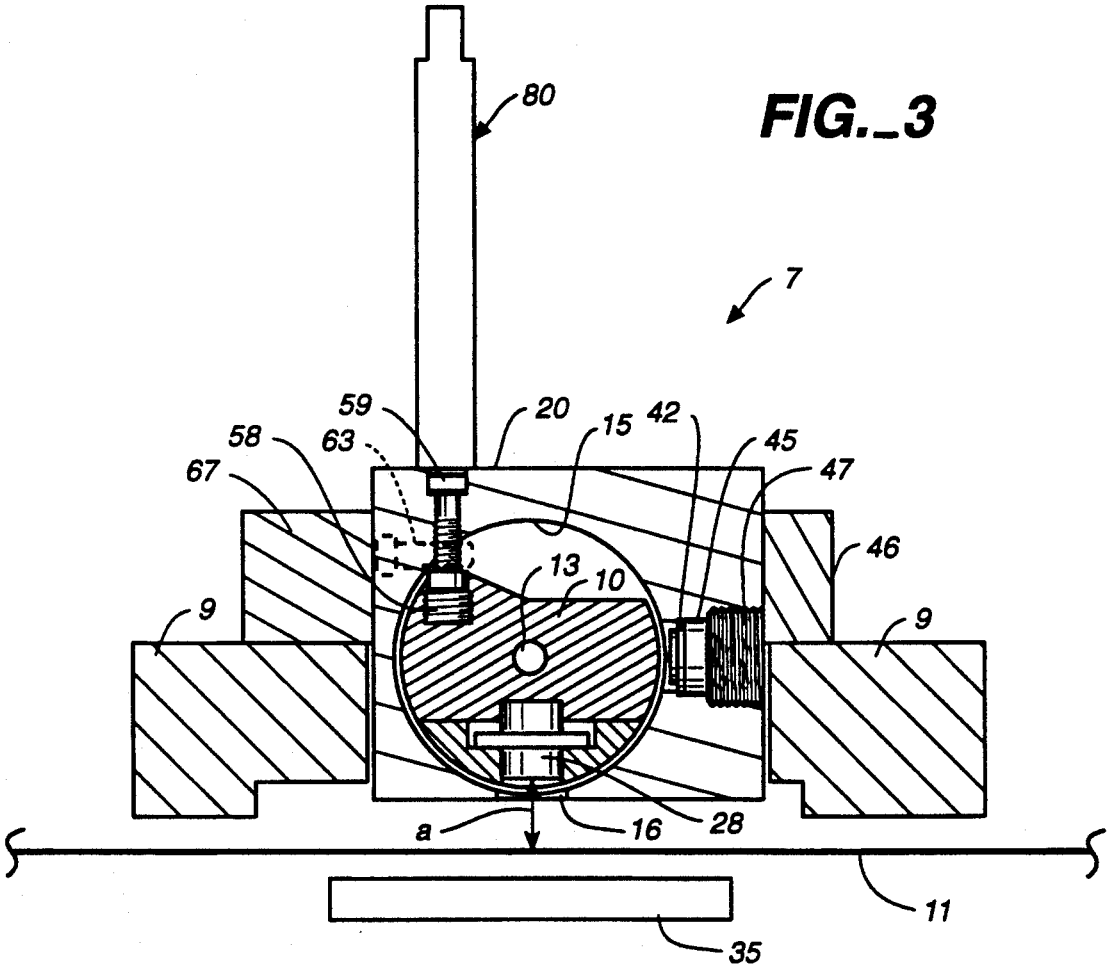
FIG. 3 is a generally schematic view, partially cutaway, showing the nuclear gauge of FIG. 2 positioned for making measurements of a web of sheet material traveling past the gauge.

FIG. 3 shows the nuclear gauge 7 positioned for making measurements of a web 11 of sheet material traveling past the gauge. More particularly, the nuclear gauge 7 is fixed to a head 9 such that the aperture 16 directly faces the traveling web 11. Then, for making measurements of the web, the wheel-like member 10 is angularly positioned so that the capsule 28 is aligned with the aperture 16. (More particularly, the opening 40 in the cradle member 29 is aligned with the aperture 16.) With the capsule 28 so located, the aperture 16 serves as a window through which the capsule emits radiation onto the web 11. A radiation detector, generally indicated by block 35, is located on the opposite side of the web 11 for detecting the quantity of radiation that passes through the web 11.

With regard to FIG. 3, it should be noted that the air column between the capsule 28 and the web 11 is relatively thin. (In the drawing, the air column is indicated by the dimension "$\alpha$".) This dimension is important because it has been found that the disturbances in the air column can affect measurements that are made by the nuclear gauge. For example, disturbances to the air column arising from environmental factors, such as temperature changes and barometric pressure changes, can alter measurements that are made by the nuclear gauge. Thus, by reducing the length of the air column, the effect of the environmental changes is reduced.

Figure 4:
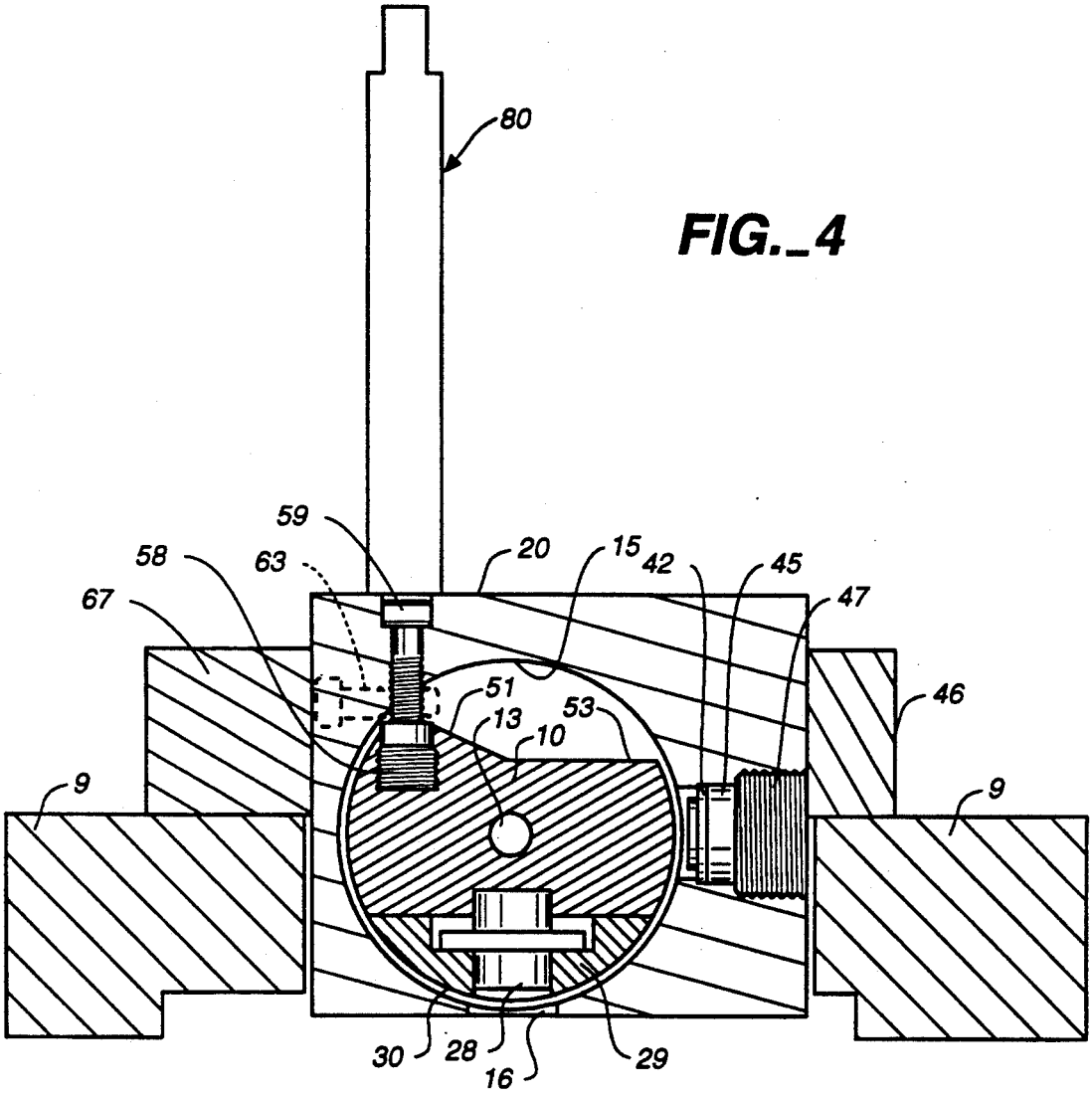
FIG. 4 is a cross-sectional view taken along the section line 4—4 in FIG. 1, showing the gauge in the open position.

In operation of the above-described nuclear gauge 7, the wheel-like member 10 is selectively rotated to carry the capsule 28 between two angularly-displaced positions within the cavity 15. The two positions are referred to herein as the open and closed positions, respectively. In the open position, as shown in FIGS. 3 and 4, the capsule 28 is positioned in alignment with the aperture 16 and, therefore, is positioned for making measurements of a web that travels past the gauge.

Figure 5:
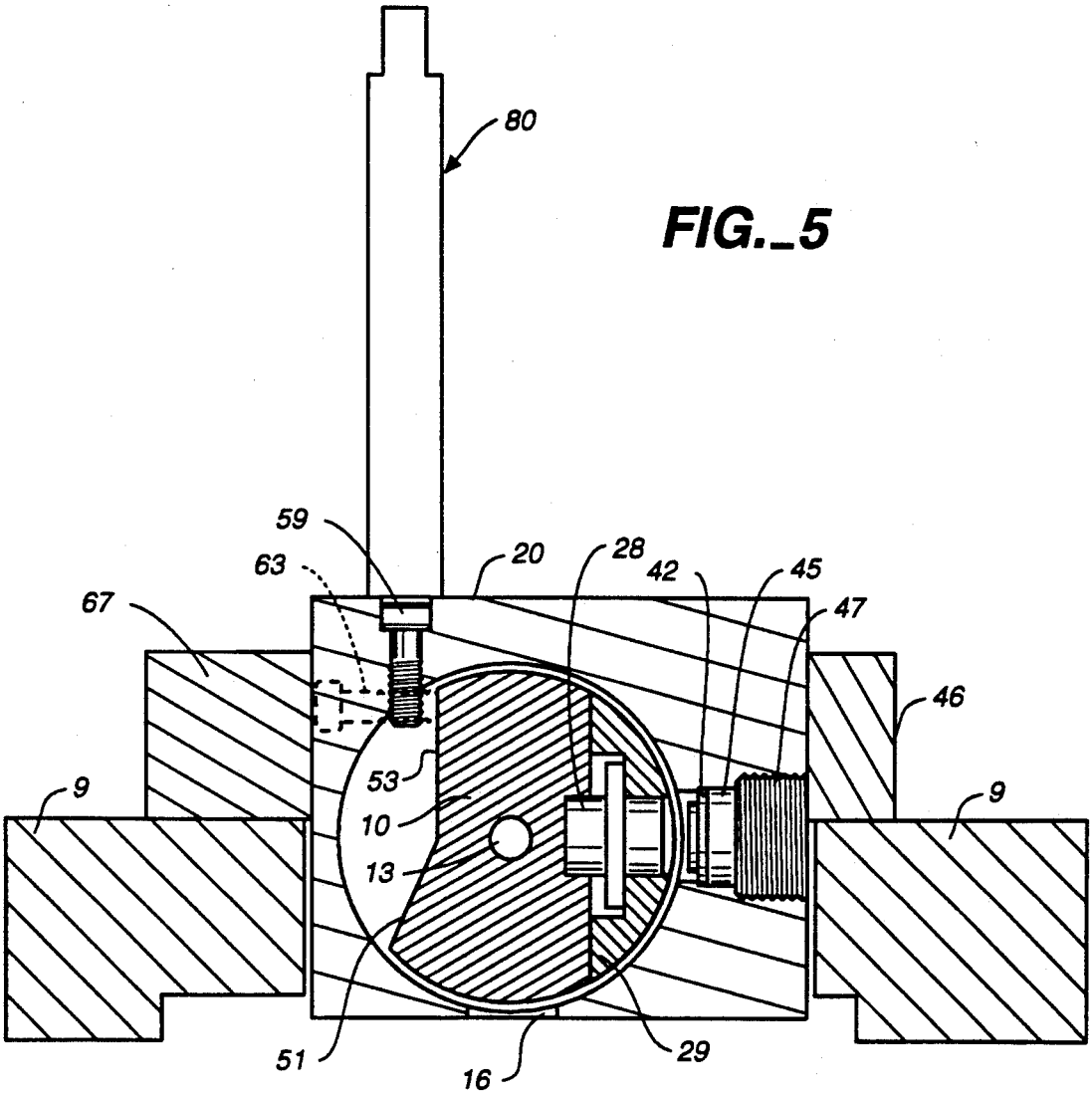
FIG. 5 is a cross-sectional view similar to FIG. 2, but showing the gauge in the closed position.

In the closed position, as shown in FIG. 5, the wheel-like member 10 is rotated to a position where the capsule 28 faces the sidewall of the cylindrical cavity 15 at a location remote from the aperture 16. Thus, in the closed position, the sidewall of the cavity 15 functions to reduce radiation emissions from the nuclear gauge. This is one of the reasons that the enclosure 20 is made from a material having a high atomic number. Normally, the wheel-like member 10 is rotated to the closed position when measurements are not being made—e.g., during storage. The open and closed positions normally are angularly displaced from each other by about ninety degrees.

As also shown in FIG. 5, a plug 42 of material having a low atomic number is mounted in an aperture 45 in the sidewall of the cavity 15. The aperture 45 is in alignment with the capsule 28 at the closed position of the wheel-like member 10. One purpose of the plug 42 is to absorb beta rays that are emitted from the capsule 28 which might otherwise scatter off the tungsten housing and escape as stray radiation from the gauge 7. Another purpose of the plug 42 is to reduce bremsstrahlung, or secondary radiation, which is generated when the beta-ray emissions encounter the tungsten housing. In practice, the plug 42 is formed from aluminum, beryllium, carbon and other low atomic number materials.

In practice, the nuclear gauge 7 is designed such that the plug 42 cannot be removed easily from the aperture 45. To this end, as shown in FIG. 5, a retainer plug 47 is mounted in aperture 45 and a retainer bar 46 is mounted to the exterior of the enclosure 20 for blocking the open end of the aperture 45. Accordingly, the plug 42 cannot be removed from the aperture 45 unless, first, the retainer plug 47 is removed and, then, the retainer bar 46 is detached from the enclosure 20. In practice, the retainer bar 46 is to fastened to the head by a means that discourages unauthorized disassembly.

In the drawings, it can be seen that the wheel-like member 10 has a generally V-shaped slot formed in its periphery. The two faces of the v-shaped slot are referred to herein as stop faces 51 and 53, respectively. An adjustable stop member 58 is mounted within a threaded aperture 57 in stop face 51. The stop member 58 normally is made of hardened steel or a similar wear-resistant material.

Referring again to FIG. 4, it can be seen that a stop pin member 59 is mounted in the enclosure 20 such that its end abuts the adjustable stop member 58 in stop face 51 when the wheel-like member 10 is at its open position. The stop pin member normally is fixed (i.e., stationary). Thus, by threading the stop member 58 into, or out of, the threaded aperture 57, the stopping position of the wheel-like member 10 at its open position can be adjusted.

Similarly, as shown in FIG. 5, a stop member 63 is mounted in enclosure 20 to abut stop face 53. The function of the stop member 63 is to abut the stop face 53 when the wheel-like member 10 is rotated to its closed position. Preferably, the stop member 63 is located such that it cannot be adjusted without, first, removing a retainer bar 67. This is done to discourage adjustments that might cause misalignment of the source in the closed position. The retainer bar 67 is attached to enclosure 20 a bolt or similar means.

A fire pin, generally designated by the number 80 will be described in connection with FIGS. 6 and 7. In particular, FIG. 6 shows the fire pin 80 in its ready position, and FIG. 7 shows the pin in its released position. The fire pin 80 is so named because, in the event of a fire or excessive heat in the vicinity of the nuclear gauge, the fire pin operates to force the wheel-like member 10 to rotate to its closed position.

Figure 6A:
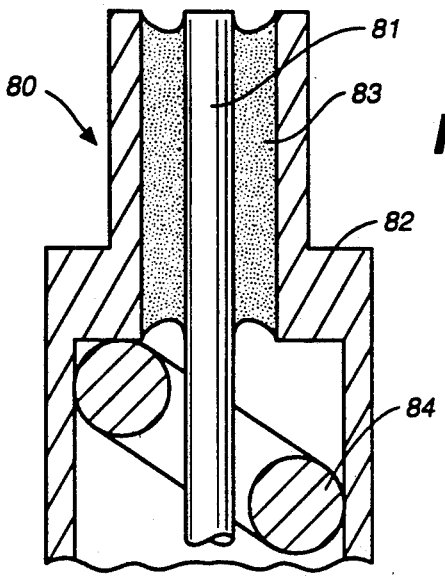
FIG. 6A is a cross-sectional detail, drawn to an enlarged scale, of the portion of the fire pin encircled by the lines 6A—6A in FIG. 6.
Figure 6:
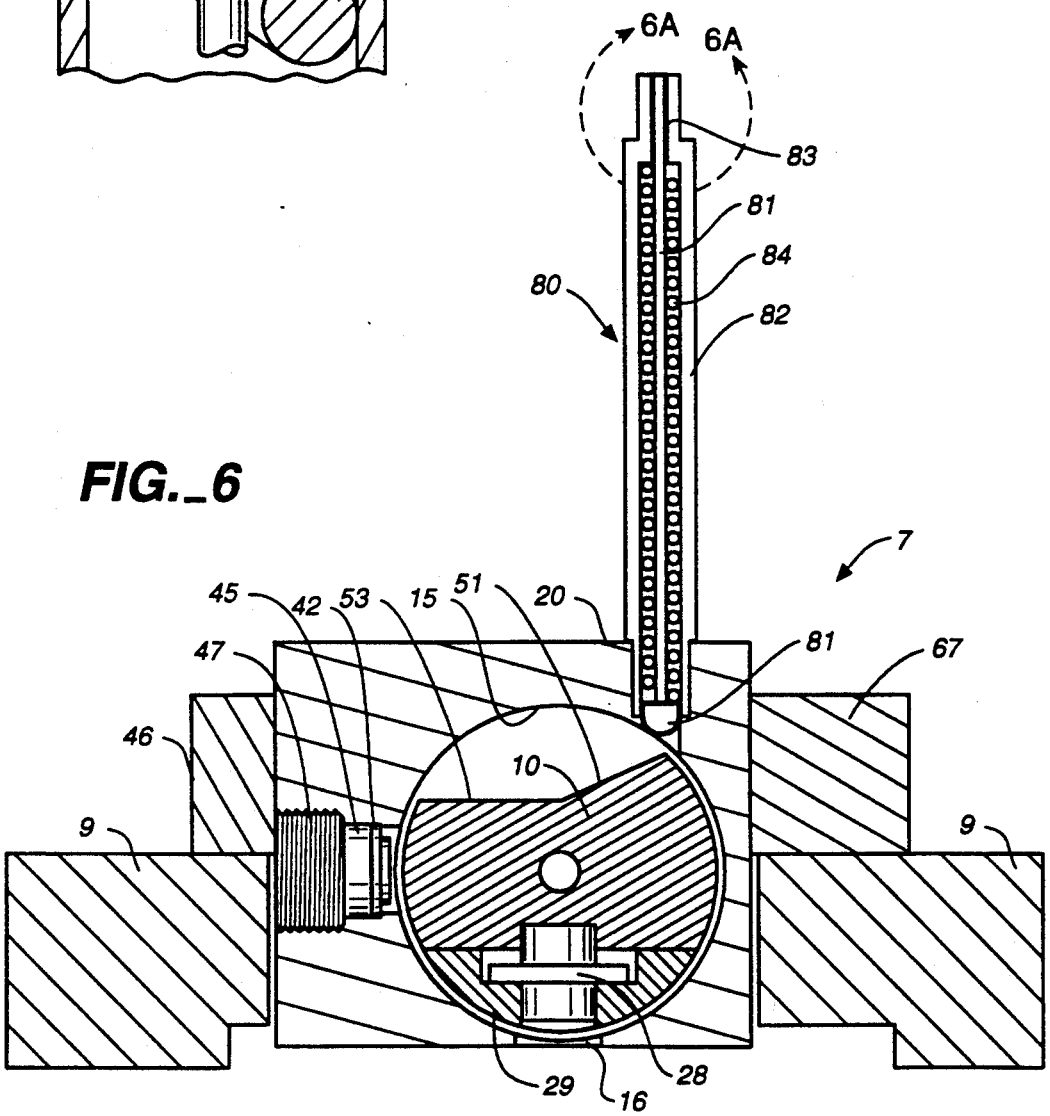
FIG. 6 is a cross-sectional view taken along the section line 4—4 in FIG. 1, particularly showing the fire pin in a first position.

The fire pin 80, as best shown in FIG. 6A, includes a pin member 81 which is biased by a spring 84 and attached within a housing 82 by a means 83 that has a low-temperature melting point. For example, the meltable means 83 can be solder. The fire pin 80 is attached to the enclosure 10 at a location such that, in its ready position, the end of the pin member 81 is positioned adjacent the face 51 of the V-shaped slot. Thus, in the event of excessive heat, the meltable means 83 releases the pin member, allowing that member to extend under the urging of the spring 84.

As shown in FIG. 7, as the spring-loaded member extends, its pressure against the face 51 of wheel-like member 10 forces the wheel-like member to rotate to its closed position. Thus, in the event of excessive heat, the spring-loaded member forces the wheel-like member to rotate to a position whereat the radiation from the capsule 28 is shielded by the body of the enclosure 10, thereby reducing the chance that radiation will be emitted from the nuclear gauge in a harmful manner.

As shown in FIG. 8, step 91 is formed in the mounting face of the cover member 24. The step 91 functions to prevent the cover member 24 from being moved from side to side.

The foregoing has described the principles, preferred embodiments and modes of operation of the present invention. However, the invention should not be construed as limited to the particular embodiment discussed. Instead, the above described embodiment should be regarded as illustrative rather than restrictive, and it should be appreciated that variations may be made in those embodiments by worker skilled in the art without departing from the scope of the present invention as defined by the following claims.

What is claimed is:

1. A nuclear gauge for making measurements of traveling webs in continuous sheet-making systems, comprising:

an enclosure means;

a cylindrical cavity formed in the enclosure means;

an aperture which is formed through the enclosure means in a direction that intersects the cylindrical cavity;

a wheel-like member rotatably mounted in the cavity;

an encapsulated nuclear source which is mounted to be carried by the wheel-like member;

rotating means for rotating the wheel-like member from a second position to a first position whereat the nuclear source can emit radiation directly through the aperture onto a web that travels past the aperture; and fire pin means for returning the wheel-like member to the second position in the event of a fire.

2. A nuclear gauge according to claim 1 wherein, at the second position, the encapsulated nuclear source is positioned to face a sidewall of the enclosure means at a location remote from the first position.

3. A nuclear gauge according to claim 1 wherein the nuclear source comprises krypton gas.

4. A nuclear gauge according to claim 1 wherein the rotating means comprises a pneumatic actuator.

5. A nuclear gauge according to claim 1 further including a plug of material having a low atomic number, which plug is mounted in the sidewall of the cavity at the second position for absorbing beta rays that are emitted from the encapsulated nuclear source.

6. A nuclear gauge according to claim 1 wherein the low atomic number material is selected from the group consisting of aluminum, beryllium, carbon and Delrin.

7. A nuclear gauge according to claim 1 wherein the wheel-like member has a generally V-shaped slot formed in its periphery, the faces of which provide stop faces.

8. A nuclear gauge according to claim 1 wherein the fire pin includes a spring-loaded member which is positioned such that, upon release, it applies pressure against one of the stop faces of wheel-like member to force the wheel-like member to rotate to the second position, thereby reducing the chance that radiation will be emitted from the nuclear gauge in a harmful manner.

9. A nuclear gauge according to claim 1 wherein the fire pin means includes a pin member releasably connected to a housing;

means for urging the pin member from the housing toward a stop face on the wheel-like member; and means for automatically releasing the pin member from the housing toward the step face in the event of the fire.

10. A nuclear gauge according to claim 9 wherein the automatic releasing means includes a melting connector.

11. A nuclear gauge according to claim 10 wherein the melting connector includes solder.

12. A nuclear gauge for making measurements of traveling webs in continuous sheet-making systems, comprising:

an enclosure means formed from a material having a high atomic number;

a cylindrical cavity formed in the enclosure means;

an aperture which is formed through the enclosure means in a direction that intersects the cylindrical cavity;

a wheel-like member rotatably mounted in the cavity;

an encapsulated nuclear source which is mounted to be carried by the wheel-like member; and rotating means for rotating the wheel-like member from a second position whereat the encapsulated nuclear source is positioned to face a the wall of the enclosure to a first position whereat the nuclear source can emit radiation directly through the aperture onto a web that travels past the aperture;

the sidewall at the second position including a plug which is formed from a material having a low atomic number for safely receiving radiation from the nuclear source at the second position.

13. A nuclear gauge according to claim 12 further comprising fire pin means for returning the wheel-like member to the second position in the event of a fire.

14. A nuclear gauge according to claim 13 wherein the wheel-like member has a generally V-shaped slot formed in its periphery, the faces of which provide stop faces.

15. A nuclear gauge according to claim 14 wherein the fire pin includes a spring-loaded member which is positioned such that, upon release, it applies pressure against one of the stop faces of wheel-like member to force the wheel-like member to rotate to the second position, thereby reducing the chance that radiation will be emitted from the nuclear gauge in a harmful manner.

16. A nuclear gauge for making measurements of traveling webs in continuous sheet-making processes, comprising:

an enclosure means formed from a material having a relatively high atomic number;

an encapsulated nuclear source; and rotatable means mounted in the enclosure means for carrying the encapsulated nuclear source between two angularly-displaced positions;

wherein the two angularly-displaced positions comprise a first position whereat the encapsulated nuclear source is positioned for making measurements of a web that travels past the gauge, and a second position whereat the encapsulated nuclear source is positioned to face a sidewall of the enclosure means at a location remote from the first position;

the sidewall of the enclosure means at the second position including a plug which is formed from a material having a relatively low atomic number for safely receiving radiation from the nuclear source at the second position.

* * * * *